US010953260B2

(12) United States Patent
Weisz

(10) Patent No.: US 10,953,260 B2
(45) Date of Patent: Mar. 23, 2021

(54) EXERCISE CASE WITH AN ADJUSTABLE RESISTANCE BAND SYSTEM

(71) Applicant: Evan Weisz, New York, NY (US)

(72) Inventor: Evan Weisz, New York, NY (US)

( * ) Notice: Subject to any disclaimer, the term of this patent is extended or adjusted under 35 U.S.C. 154(b) by 12 days.

(21) Appl. No.: 16/119,831

(22) Filed: Aug. 31, 2018

(65) Prior Publication Data

US 2019/0060695 A1 Feb. 28, 2019

Related U.S. Application Data

(63) Continuation-in-part of application No. 15/467,942, filed on Mar. 23, 2017.

(60) Provisional application No. 62/552,881, filed on Aug. 31, 2017.

(51) Int. Cl.

| | |
|---|---|
| ***A63B 21/04*** | (2006.01) |
| ***A63B 21/055*** | (2006.01) |
| ***A63B 21/16*** | (2006.01) |
| ***A63B 21/00*** | (2006.01) |
| ***A63B 71/00*** | (2006.01) |
| ***A63B 23/12*** | (2006.01) |
| ***A63B 71/02*** | (2006.01) |
| ***A63B 23/02*** | (2006.01) |
| ***A63B 69/00*** | (2006.01) |

(52) U.S. Cl.

CPC .... *A63B 21/0442* (2013.01); *A63B 21/00069* (2013.01); *A63B 21/0557* (2013.01); *A63B 21/1609* (2015.10); *A63B 71/0036* (2013.01); *A63B 23/0211* (2013.01); *A63B 23/12* (2013.01); *A63B 69/0062* (2020.08); *A63B 2071/027* (2013.01); *A63B 2225/00* (2013.01); *A63B 2225/09* (2013.01)

(58) Field of Classification Search

CPC ..... A63B 21/0442; A63B 71/0036; A63B 21/00069; A63B 21/1609; A63B 21/0557; A63B 23/0211; A63B 2071/027; A63B 2069/0062; A63B 2225/09; A63B 23/12; A63B 2225/00

See application file for complete search history.

(56) References Cited

U.S. PATENT DOCUMENTS

| | | | | |
|---|---|---|---|---|
| 1,715,870 A * | 6/1929 | Spain | A63B 21/0552 482/72 |
| 3,664,666 A * | 5/1972 | Lloyd | A63B 17/00 482/133 |
| 3,893,667 A * | 7/1975 | Snyder, Jr. | A63B 21/018 482/114 |

(Continued)

*Primary Examiner* — Sundhara M Ganesan
(74) *Attorney, Agent, or Firm* — Andrew Morabito

(57) ABSTRACT

An exercise system includes a portable case that has a base with a selectively openable top and at least one peripheral edge. The top when engaged with the base defines an internal storage volume therein. At least one resistance band is adapted for storing in the internal storage volume of the case and has a plurality of apertures therethrough. At least one anchor is fixed with the at least one peripheral edge of the case and is adapted for fixing with the at least one resistance band through one of the apertures thereof. Preferably each anchor is selectively detachable from an anchor aperture traversing the case. As such, with the at least one resistance band fixed with the case, and with the case pressed against the item within the environment by the person, the person may perform exercises by stretching the at least one resistance band.

18 Claims, 10 Drawing Sheets

(56) References Cited

U.S. PATENT DOCUMENTS 5,551,934 A * 9/1996 Binette ..... A63B 23/0482 482/123
5,658,222 A * 8/1997 Brown ..... A63B 21/0552 482/51
5,813,953 A * 9/1998 Whipple ..... A63B 21/169 482/123
5,839,991 A * 11/1998 Hall ..... A63B 23/00 482/23
6,110,083 A * 8/2000 Riser ..... A63B 21/154 482/142
7,001,315 B1 * 2/2006 Diodati ..... A63B 21/0552 482/104
7,922,624 B1 * 4/2011 Fairhurst ..... A63B 21/0552 482/52
7,942,793 B2 * 5/2011 Mills ..... A63B 21/00069 482/126
8,715,144 B1 * 5/2014 Friess ..... A63B 21/4035 482/123
9,061,172 B1 * 6/2015 Carrier ..... A63B 23/0458
9,737,748 B1 * 8/2017 Chapman ..... A63B 21/0442
2006/0058166 A1 * 3/2006 Normandia ..... A63B 21/153 482/121
2006/0128540 A1 * 6/2006 Engle ..... A63B 21/04 482/123
2007/0087920 A1 * 4/2007 Dachraoui ..... A63B 21/0552 482/123
2008/0318743 A1 * 12/2008 Bizzell ..... A63B 21/0004 482/142
2010/0101973 A1 * 4/2010 Kim ..... A63B 21/05 206/579
2010/0126902 A1 * 5/2010 Garza, Jr. ..... A63B 21/4043 206/579
2010/0204023 A1 * 8/2010 Mills ..... A63B 21/00069 482/121
2010/0255966 A1 * 10/2010 Aucamp ..... A63B 21/0552 482/131
2012/0244997 A1 * 9/2012 Thompson ..... A63B 5/11 482/27
2013/0090216 A1 * 4/2013 Jackson ..... A63B 21/018 482/52
2013/0130873 A1 * 5/2013 Piga ..... A63B 21/0552 482/123
2013/0231228 A1 * 9/2013 Wyatt ..... A63B 71/0036 482/130
2016/0096062 A1 * 4/2016 Moerth-Cross ..... A61G 13/105 482/101
2017/0100622 A1 * 4/2017 Wall ..... A63B 21/0552
2017/0165552 A1 * 6/2017 Martin ..... A63B 69/06
2018/0296875 A1 * 10/2018 Christoforou ..... A61F 17/00
2018/0333632 A1 * 11/2018 Mitsis-Koutoukis ..... A63B 71/0036
2018/0339181 A1 * 11/2018 Weisz ..... A63B 23/04
2019/0240528 A1 * 8/2019 Donnelly ..... B65D 21/0204

* cited by examiner

EXERCISE CASE WITH AN ADJUSTABLE RESISTANCE BAND SYSTEM

CROSS-REFERENCE TO RELATED APPLICATIONS

This application claims the benefit of priority under 35 USC 120 of U.S. application Ser. No. 15/467,942 and provisional patent application 62/552,881 filed on Aug. 31, 2017. The disclosure of the prior applications is considered part of (and is incorporated by reference in) the disclosure of this application.

BACKGROUND

This invention relates to exercise devices, and more particularly to a resistance-band type exercise device used with a portable case.

Exercise devices are well known in the prior art, most requiring significant floor space. Further, many exercise machines are design for facilitating only a few different exercises, and thus multiple exercise machines must be provided if a person is going to exercise a wide variety of muscle groups. The typical gym is outfitted with dozens of different machines.

For those not able or desiring to exercise at a gym, and particularly for those who travel frequently or enjoy exercising outdoors or in different locations, there are insufficient and inadequate options for facilitating a variety of exercises with a portable, easily carried, expandable exercise device.

Therefore, there is a need for a portable exercise system that allows a user to perform a variety of exercises in a variety of ways just by using a support surface, chair or the like. Such a needed system would be self-contained, portable, and easily transported. Such a needed invention would further be durable, relatively easy to manufacture and use, and relatively inexpensive when compared with traditional exercise machines. The present invention accomplishes these objectives.

SUMMARY OF THE INVENTION

The present device is an exercise system for a person in an environment, such as a room having a floor or support surface and a chair, or a park having a bench and a sidewalk, or the like. A portable case has a base with a selectively openable top and at least one peripheral edge. The top when engaged with the base defines an internal storage volume therein. The top has a top surface configured for contacting the person, and the base has a bottom surface configured for contacting an item in the environment, such as a support surface, a chair, or the like.

Preferably the top is pivotally fixed with the base with at least one hinge and also preferably includes at least one cushion made with a pliable or malleable material. Preferably the bottom surface includes a low-friction material, such as a Teflon®-type material, adapted for facilitating the sliding of the case along the support surface. Similarly, the bottom surface of the base may include a high-friction material, such as a high-friction foam material, for inhibiting sliding of the case along the support surface in the environment, such as is necessary for certain exercises requiring the base to be positionally fixed.

At least one resistance band is adapted for storing in the internal storage volume of the case and has a plurality of apertures therethrough. At least one handle is adapted for selective attachment to any of the apertures in the at least one resistance band, such as with a carabiner clip or the like. At least one anchor is fixed with the at least one peripheral edge of the case and is adapted for fixing with the at least one resistance band through one of the apertures thereof. Preferably each anchor is selectively detachable from an anchor device traversing the case.

As such, with the at least one resistance band fixed with the case, and with the case pressed against the item within the environment by the person, the person may perform exercises by stretching the at least one resistance band.

In some embodiments, the at least one of the resistance band includes a raised, reinforced section around the aperture thereof, each anchor including a recessed portion cooperative with the raised, reinforced section to rotationally capture the resistance band on the anchor when the anchor is fixed with the resistance band and fully engaged with one of the anchor devices. As such, any pulling force experienced by the resistance band is transferred to the anchor as well as the recessed portion, reducing the force experienced by the anchor device anchor against the anchor and prolonging the useful life of the resistance band.

Preferably the base further includes a plurality of partitions for dividing the internal storage volume into a plurality of compartments and for reinforcing the case to further withstand the weight of the person.

In some embodiments the at least one peripheral edge includes at least one extension aperture through which an extension tube can be extended from within the case. A distal end of the extension tube is adapted for securing to at least one accessory item, such as one of the anchors, a cross-beam riser that is attached to opposing foot retention plates, a cross beam riser, resistance band, or the like. Such a cross-beam riser is preferably adapted to hold a cross beam proximate the center thereof, the cross beam having two opposing ends each adapted to receive a grip thereon, such as with a threaded aperture. Such a grip may be rotated with respect to the cross beam to move the grip either closer to or away from the center of the cross beam, such as with a thread arrangement. Preferably a distal end of each grip includes one of the anchor devices.

The extension tube may include an inner extension tube and an outer extension tube selectively mutually secured at a length adjustment mechanism, such that the extension tube is telescoping. Such a length adjustment mechanism preferably comprises a plurality of alignable adjustment apertures in extension tube, and at least one adjustment pin or bolt for selectively placing into two corresponding aligned adjustment apertures in both the inner and outer extension tubes to lock the inner and outer extension tubes mutually together. Each extension tube preferably includes a plurality of the anchor devices each adapted for electively fixing one of the at least one anchor thereto.

The present invention is a portable exercise system that allows a user to perform a variety of exercises in a variety of ways just by using a support surface, chair or the like. The present system is self-contained, portable, and easily transported. Further, the system of the present invention is durable, relatively easy to manufacture and use, and relatively inexpensive when compared with traditional exercise machines. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements but can also mean a singular element.

Figure 1C:
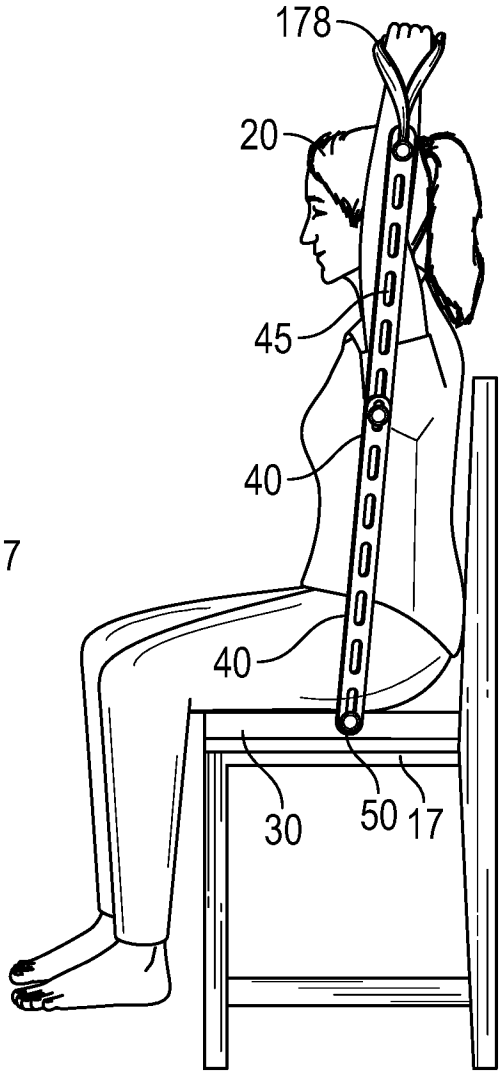
FIG. 1C is a side view of yet another configuration of the invention as used with the chair by the person to perform exercises.
Figure 1B:
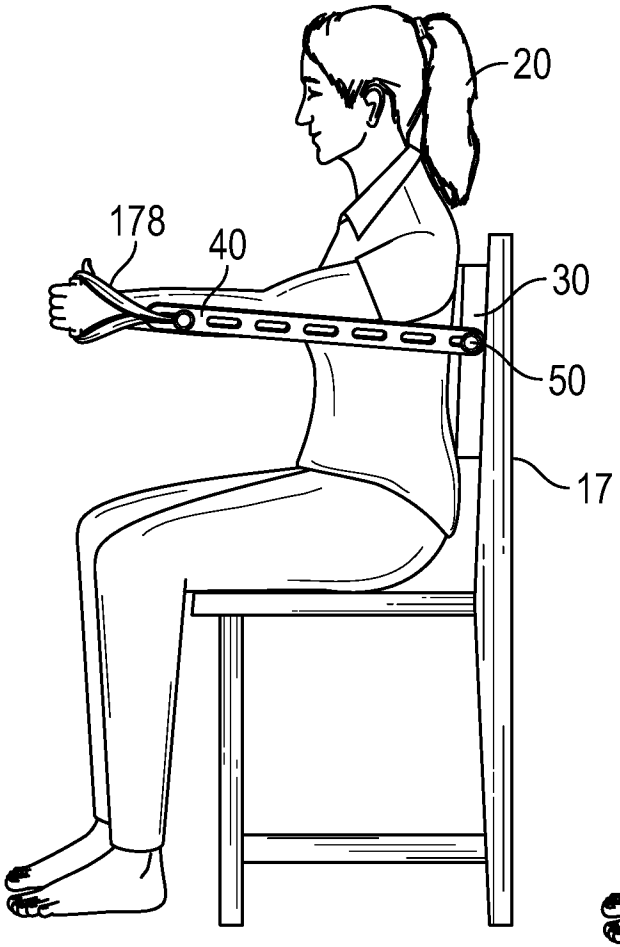
FIG. 1B is a side view of another configuration of the invention as used with the chair by the person to perform exercises.
Figure 1A:
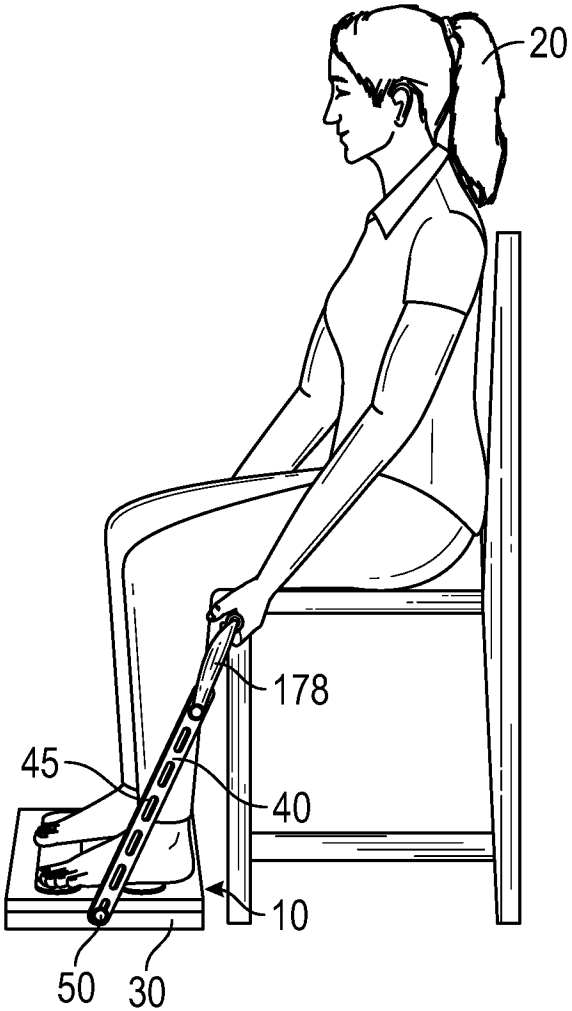
FIG. 1A is a side view of a one configuration of the invention as used with a chair by the person to perform exercises.
Figure 1D:
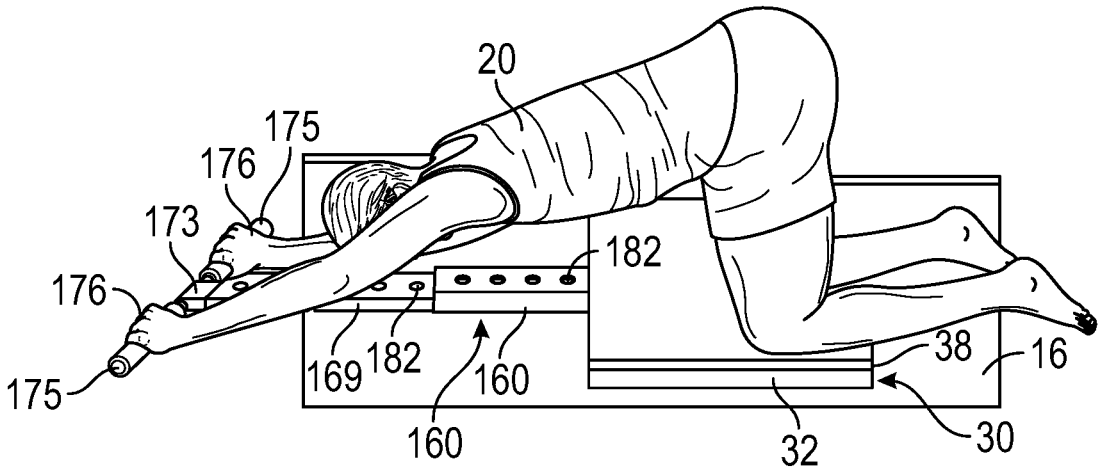
FIG. 1D is a side perspective view of the invention as used with a support surface by the person to perform exercises.
Figure 1E:
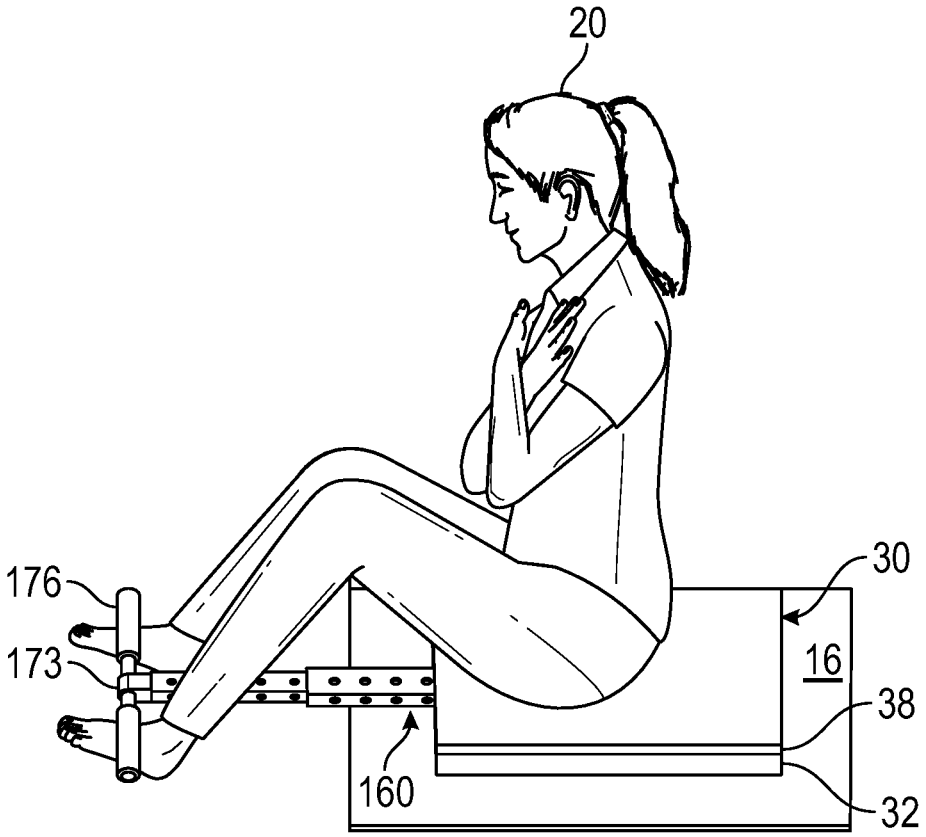
FIG. 1E is another configuration of the invention as used with the support surface by the person to perform exercises.
Figure 2:
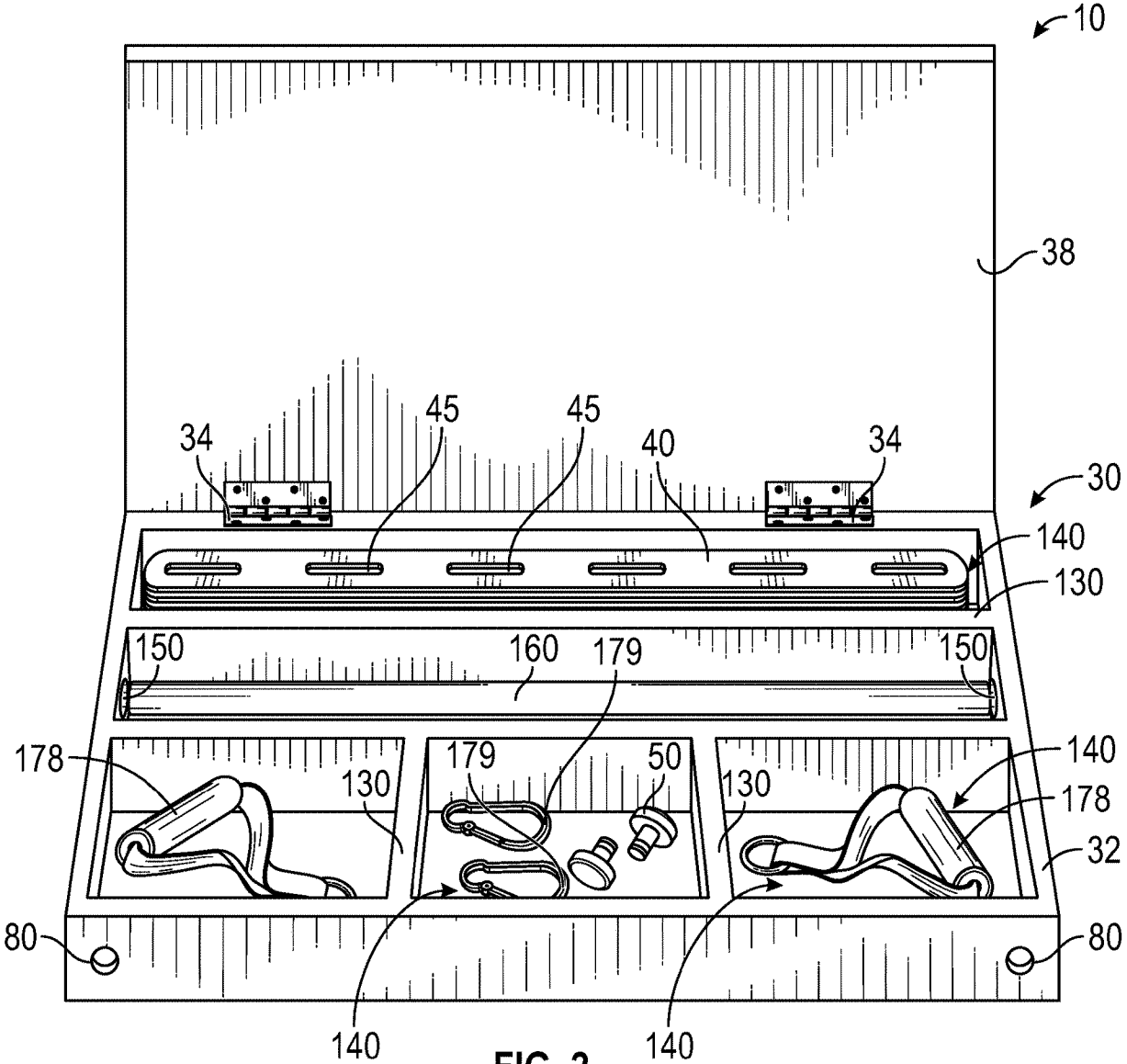
FIG. 2 is a perspective view of a case of the invention, illustrated in an open configuration and containing a plurality of exercise accessories.
Figure 3:
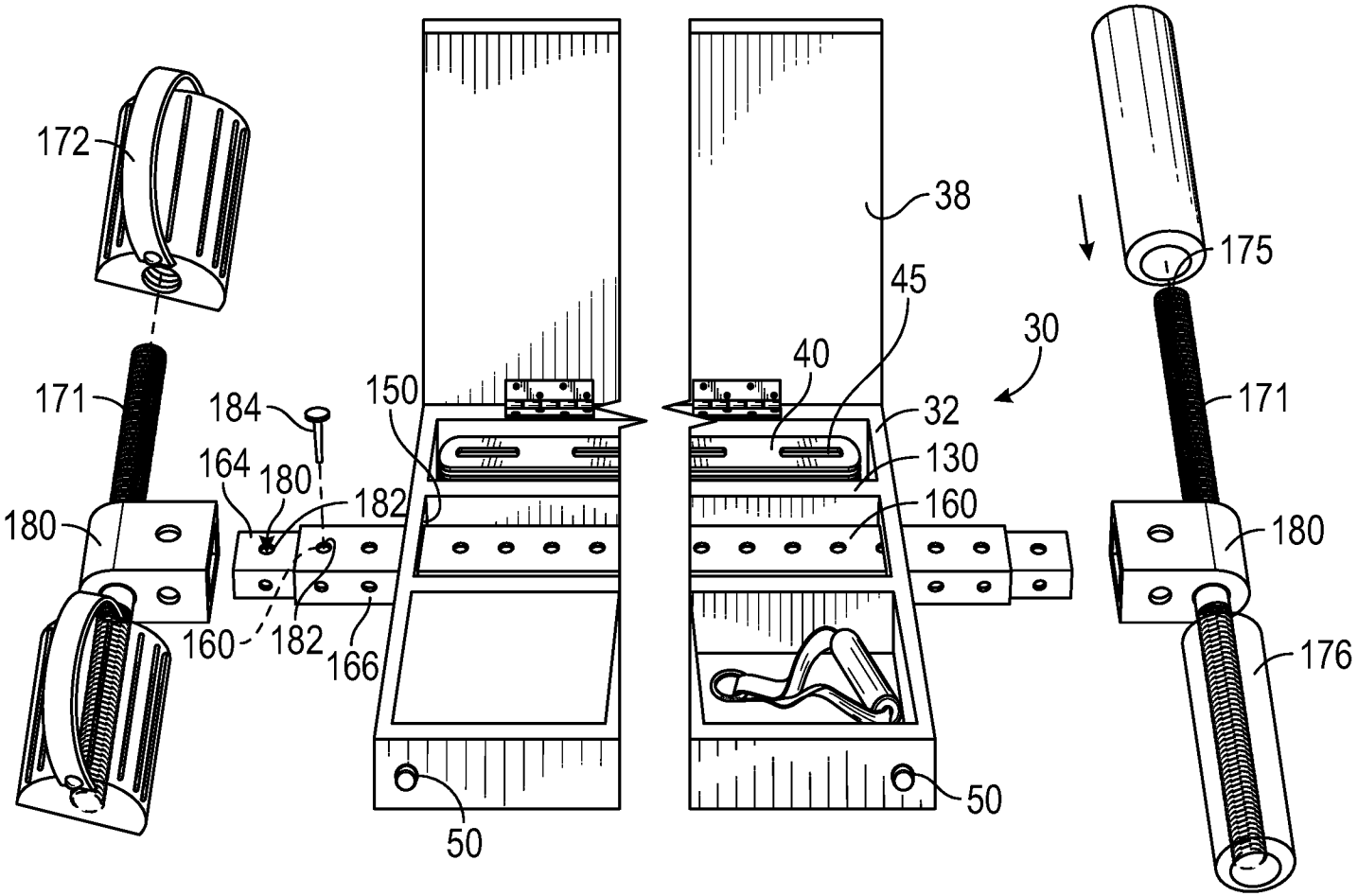
FIG. 3 is an alternate perspective view of the case of the invention, partially broken away, illustrating foot retention pieces and grips.
Figure 4:
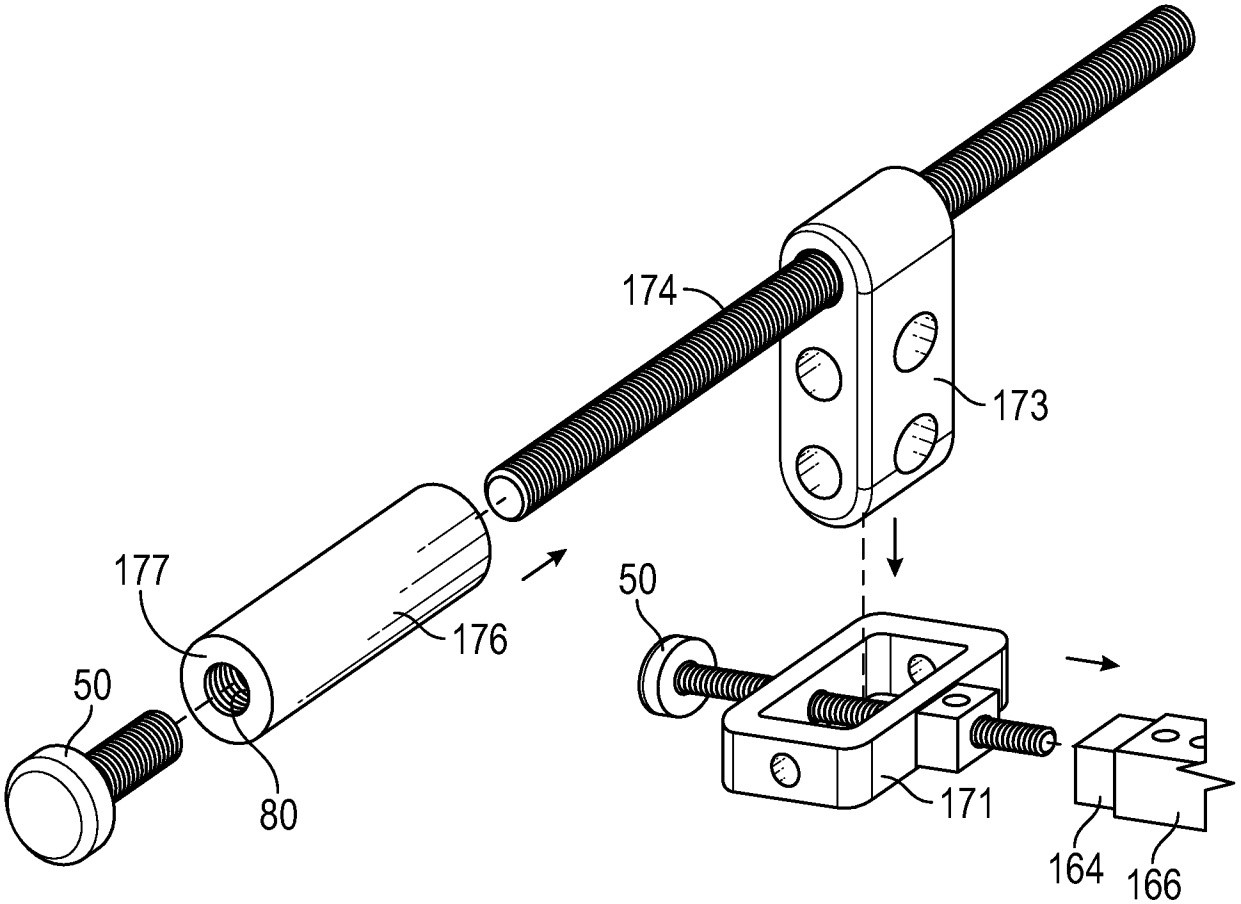
FIG. 4 is a partial perspective view of the invention, illustrating a cross-beam riser and a cross beam.

FIGS. 1A-2 illustrate an exercise system 10 for a person 20 in an environment, such as a room having a floor or support surface 16 and a chair 17, or a park (not shown) having a bench and a sidewalk, or the like.

FIGS. 1A-10 illustrate the exercise system 10 and various embodiments of the exercise system 10. A portable case 30 has a base 32 with a selectively openable top 38 and at least one peripheral edge 35. The top 38 when engaged with the base 32 defines an internal storage volume 60 therein. The top 38 has a top surface 39 configured for contacting the person 20, and the base 32 has a bottom surface 31 configured for contacting an item in the environment 15, such as a support surface 16, a chair 17, or the like. The case 30 is preferably a rectangular shape in one view but may be any other suitable shape. The case 30 preferably includes a carrying handle (not shown) fixed along the at least one peripheral edge 35. Preferably the case 30 is configured to be attached to a chair, bench, walker, wheelchair, or the like.

Preferably the top 38 is pivotally fixed with the base 32 with at least one hinge 34. Alternately top 38 may be slidably affixed to the base 32 with a pair of mechanical rails (not shown), with a plurality of hook-and-loop type fasteners (not shown), or the like. The top 38 also preferably includes at least one cushion 70 (FIG. 6) made with a pliable or malleable material such as an open or closed cell foam material, memory foam material, bean bag beads, or the like.

Preferably the bottom surface 31 includes a low-friction material 90 (FIG. 6), such as a Teflon®-type material, adapted for facilitating the sliding of the case 30 along the support surface 16. Alternately, a plurality of wheels (not shown) may be attached. To further aid the case 30 sliding along the support surface 16 for certain exercises, the case 30 may include rounded corners 100 (FIG. 6) to inhibit snags. The low-friction material 90 may be further included on a shell 110 that is selectively attachable to the bottom surface 31 of the base 30, such as with a hook-and-loop type fastener, magnetic fastener, mechanical snaps, or other mechanical fastening mechanisms (not shown).

Similarly, the bottom surface 31 of the base 30 may include a high-friction material 120, such as a high-friction foam material, for inhibiting sliding of the case 30 along the support surface 16 in the environment 15, such as is necessary for certain exercises requiring the base 30 to be positionally fixed. The high-friction material 120 may be further included on a second shell 111 that is selectively attachable to the bottom surface 31 of the base 30, such as with a hook-and-loop type fastener, magnetic fastener, mechanical snaps, or other mechanical fastening mechanisms (not shown).

At least one resistance band 40 is adapted for storing in the internal storage volume 60 of the case 30 and has a plurality of apertures 45 therethrough. At least one handle 178 is adapted for selective attachment to any of the apertures 45 in the at least one resistance band 40 (FIGS. 1A, 1B, and 2), such as with a carabiner clip 179 or the like.

At least one anchor 50 is fixed with the at least one peripheral edge 35 of the case 30 and is adapted for fixing with the at least one resistance band 40 through one of the apertures 45 thereof. Preferably each anchor 50 is selectively detachable from an anchor device 80 traversing the case 30 (FIG. 2).

As such, with the at least one resistance band 40 fixed with the case 30, and with the case 30 pressed against the item within the environment 15 by the person 20, the person 20 may perform exercises by stretching the at least one resistance band 40. The person 20 may stand on the case 30 (FIG. 1A), sit on the case 30 (FIG. 1C), press the case 30 between a wall or chair back (FIG. 1B), or otherwise position the case 30 to perform a variety of exercises (FIGS. 1D and 1E).

In some embodiments, the at least one of the resistance band 40 includes a raised, reinforced section 48 (FIG. 7) around the aperture 45 thereof, each anchor 50 including a recessed portion 56 cooperative with the raised, reinforced section 48 to rotationally capture the resistance band 40 on the anchor 50 when the anchor 50 is fixed with the resistance band 40 and fully engaged with one of the anchor devices 80. As such, any pulling force experienced by the resistance band 40 is transferred to the anchor 50 as well as the recessed portion 56, reducing the force experienced by the anchor aperture anchor 45 against the anchor 50 and prolonging the useful life of the resistance band 40. In some embodiments, the anchor 50 has an extension (e.g. knob, hook, D-ring, post, ring, or fastening device) for detachably securing the resistance band 40 to the anchor 50. In additional embodiments, the anchors 50 may be secured direct to one or more of the surfaces of the case 30.

Preferably the base 30 further includes a plurality of partitions 130 for dividing the internal storage volume 60 into a plurality of compartments 140 and for reinforcing the case 30 to further withstand the weight of the person 20.

In some embodiments the at least one peripheral edge 35 includes at least one extension aperture 150 through which an extension tube 160 can be extended from within the case 30. A distal end 168 of the extension tube is adapted for securing to at least one accessory item, such as one of the anchors 50, a cross-beam 171, a cross-beam riser 173 that is attached to opposing foot retention plates 172 (FIG. 3), a cross beam riser 173 (FIG. 4), or the like. Such a cross-beam riser 171 is preferably adapted to hold a cross beam 174 proximate the center thereof, the cross beam 174 having two opposing ends 175 each adapted to receive a grip 176 thereon (FIG. 3), preferably with a thread arrangement. Such a grip 176 may be rotated with respect to the cross beam 174 to move the grip 176 either closer to or away from the center of the cross beam 174, such as with a thread arrangement. Preferably a distal end 177 of each grip 176 includes one of the anchor devices 80. In some embodiments the cross-beam 171 or 174 is telescoping. In some embodiments, the cross beam (171 or 174), or the handle 176 or may be a unitary design, wherein the cross beam is telescoping and an attachment rod 190 is secured to the ends of the cross beam 171 is to attach the various accessory items (e.g. handle 176, foot retention plate 172, or the like).

Figure 5:
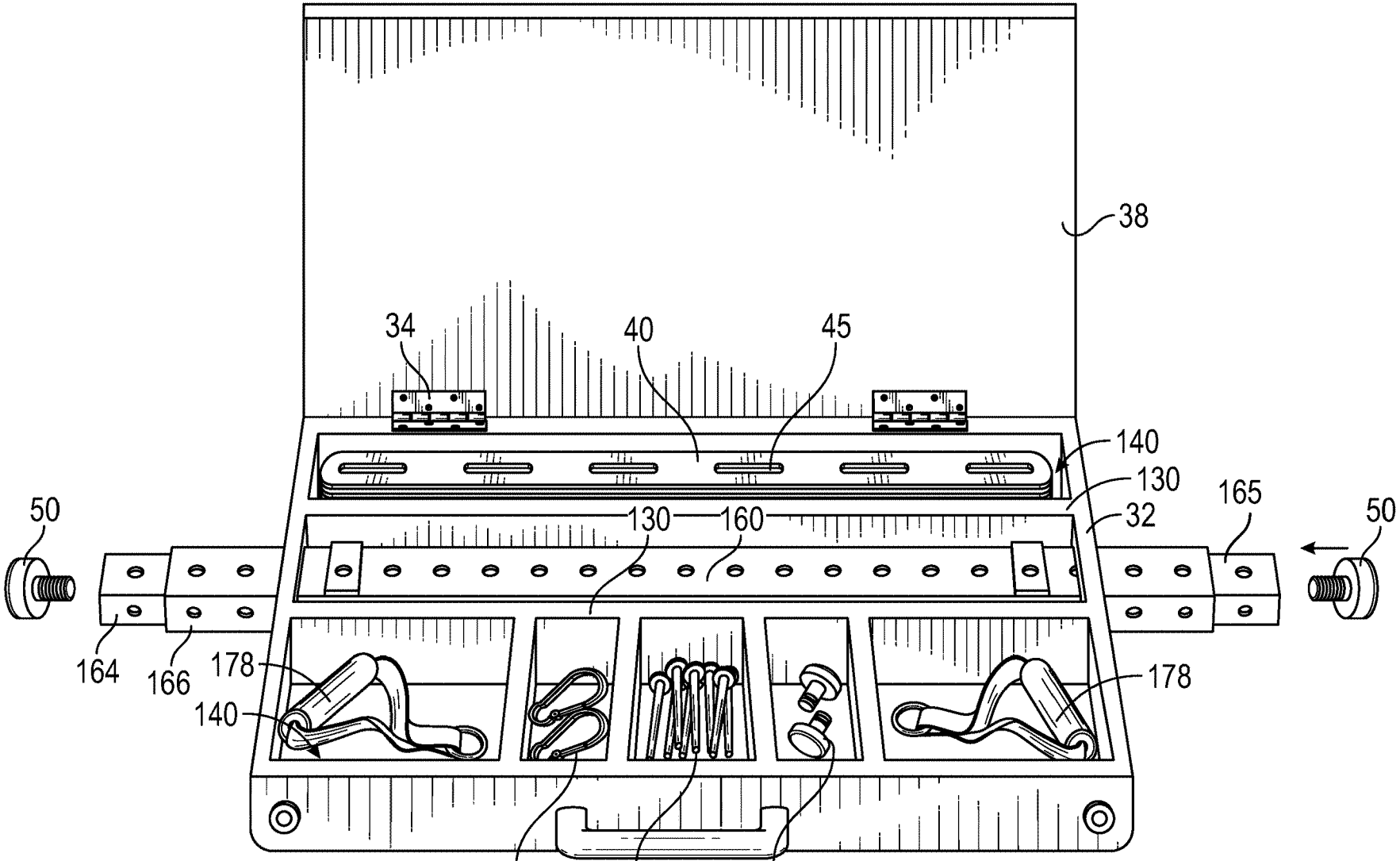
FIG. 5 is an alternate perspective view of the case in the open configuration, illustrating an extension tube embodiment.
Figure 6:
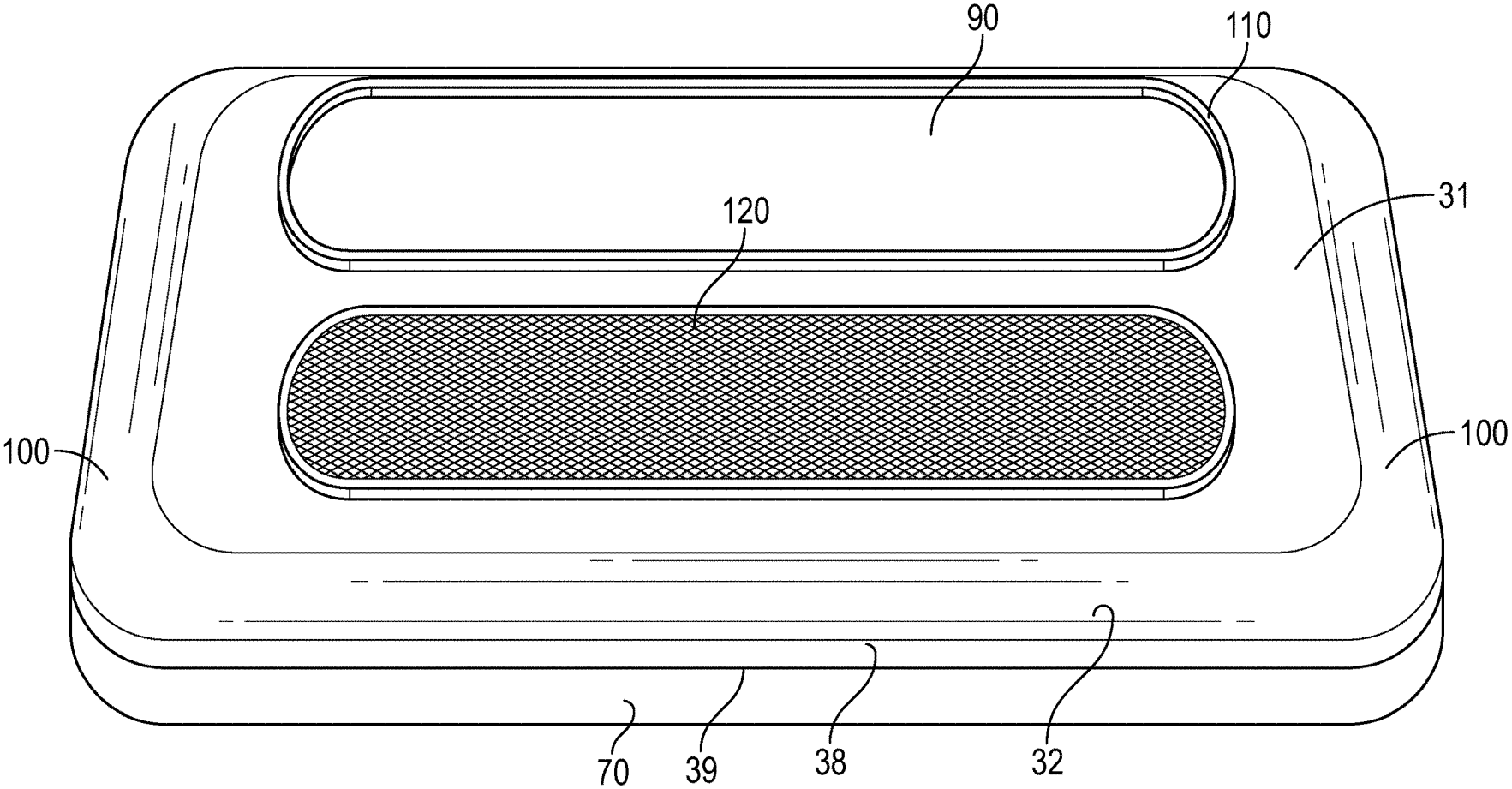
FIG. 6 is a bottom perspective view of the case, illustrating optional and removable low-friction and high-friction materials that can be selectively added to a bottom surface of the case.
Figure 7:
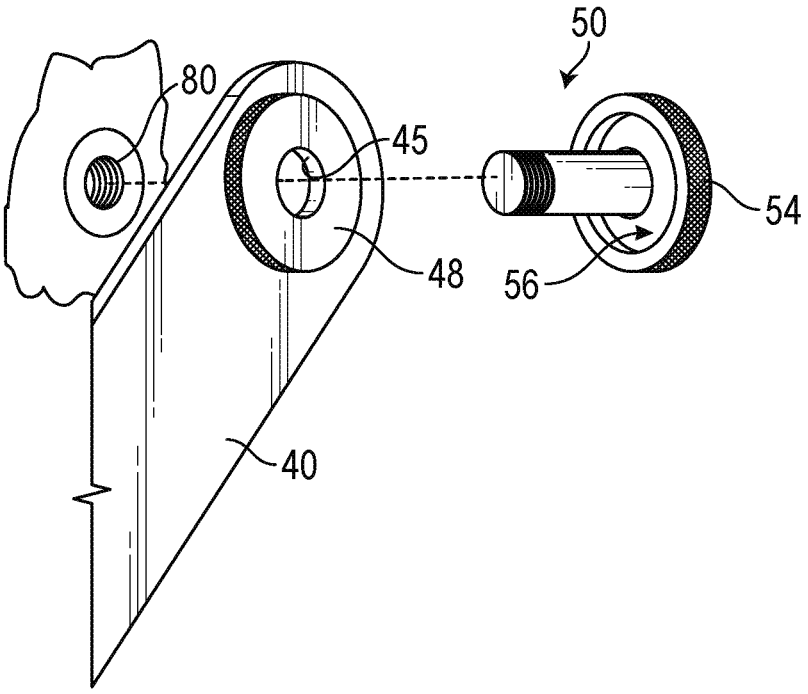
FIG. 7 is a partial perspective view of one end of an alternate embodiment of the resistance band and anchor.

The extension tube 160 may include an inner extension tube 164 and an outer extension tube 166 selectively mutually secured at a length adjustment mechanism 180, such that the extension tube 160 is telescoping (FIG. 5). Such a length adjustment mechanism 180 preferably comprises a plurality of alignable adjustment apertures 182 in extension tube 164,166, and at least one adjustment pin 184 for selectively placing into two corresponding aligned adjustment apertures 182 in both the inner and outer extension tubes 164,166 to lock the inner and outer extension tubes 164,166 mutually together. The adjustment pin 184 may be a tapered pin, a pin with a plurality of spring-biased ball-bearings that normally extend outward except when a release actuator is depressed (not shown), a spring-loaded pin (not shown), a zip-tie (not shown), or the like. Each extension tube 164,166 preferably includes a plurality of the anchor devices 80 each adapted for electively fixing one of the at least one anchor 50 thereto. Preferably each anchor device 80 and each adjustment aperture 182 are of the same diameter for this purpose.

The at least one accessory item preferably includes the grip 176, each grip 176 having at a distal end 177 thereof one of the anchor devices 80. An attachment rod 190 (FIG. 9) may be connected between any of the extension tubes 160, 164,165,166 and the grip 176 or other accessories. In some embodiments extension tubes 164, 165, and/or 166 are telescoping. In some embodiments, the attachment rod 190 can extend out from the extension tube 160 at one or both ends thereof. In additional embodiments, the attachment rod 190 may be various types of anchors, such as but not limited to knob, hook, D-ring, post, ring, or fastening devices. The grips 176 and/or sections at the ends can be separately and selectively removed and attached to other attachment accessories (not shown). The attachment rod 190 can further include a plurality of anchoring apertures on its ends and along the length of the attachment rod 190 (not shown). Further, the attachment rod 190 can be segmented, wherein individual segments (not shown) can be mutually attached or detached for easy storage. The attachment rod 190 may be hollow for attachment to the cross-beam riser 173, other extension tubes 160, or the like. Moreover, the grips 176 can preferably be detached and used separately in conjunction with the resistance bands 40 and anchoring devices.

The attachment rod 190 segments can be detached and connected with a pivoting piece (not shown) to the horizontal extension tubes 160 and the hand grips 176 can be attached to the pivot section 200 at the ends perpendicularly through anchor devices 80 for crunch exercises, for example.

Figure 8A:
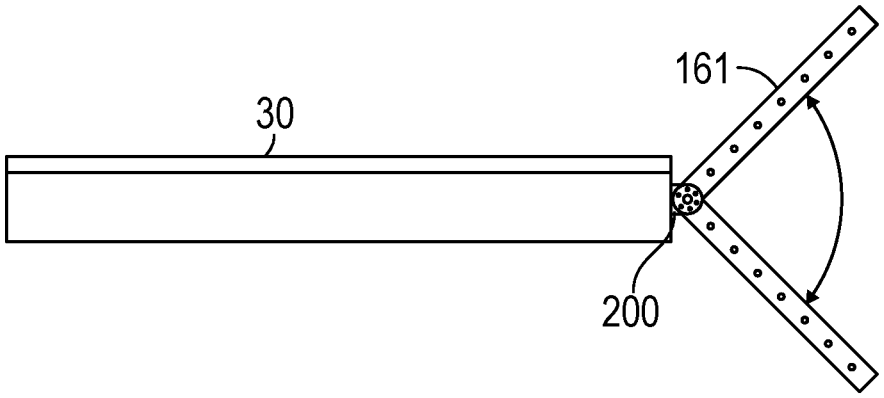
FIG. 8A is a side elevational view of an alternate embodiment of the extension tube.
Figure 8B:
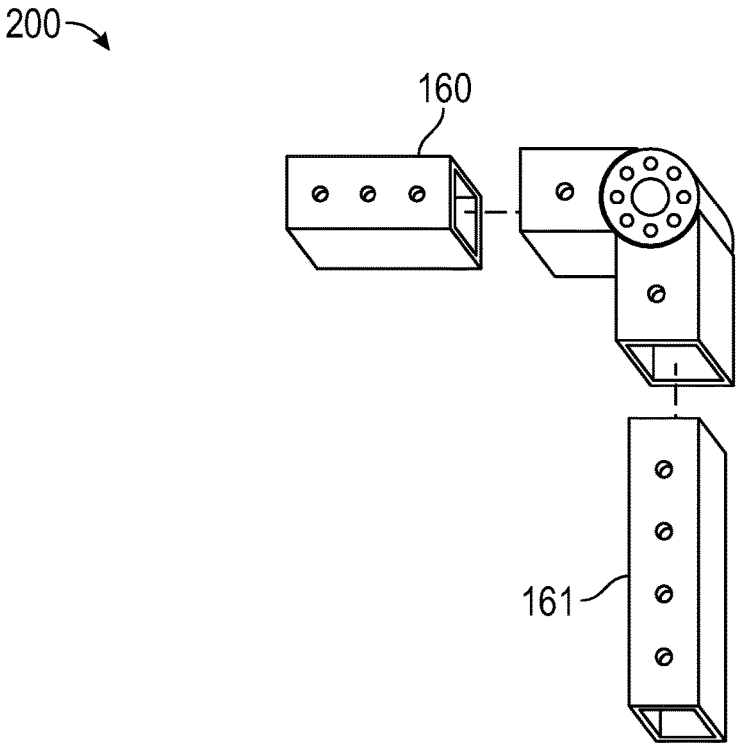
FIG. 8B is a partial exploded perspective view of a pivot section of FIG. 8A.
Figure 9:
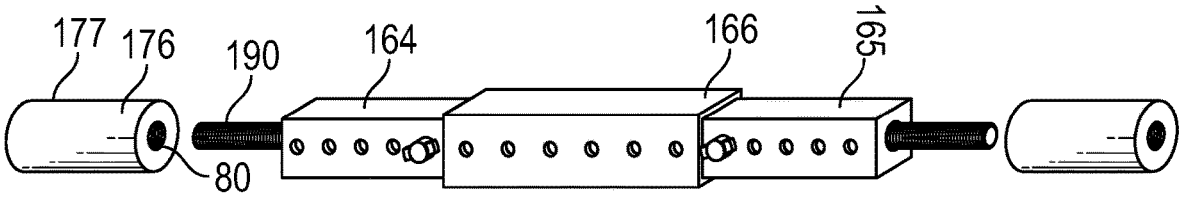
FIG. 9 is a perspective view of an alternate embodiment of an extension tube.
Figure 10:
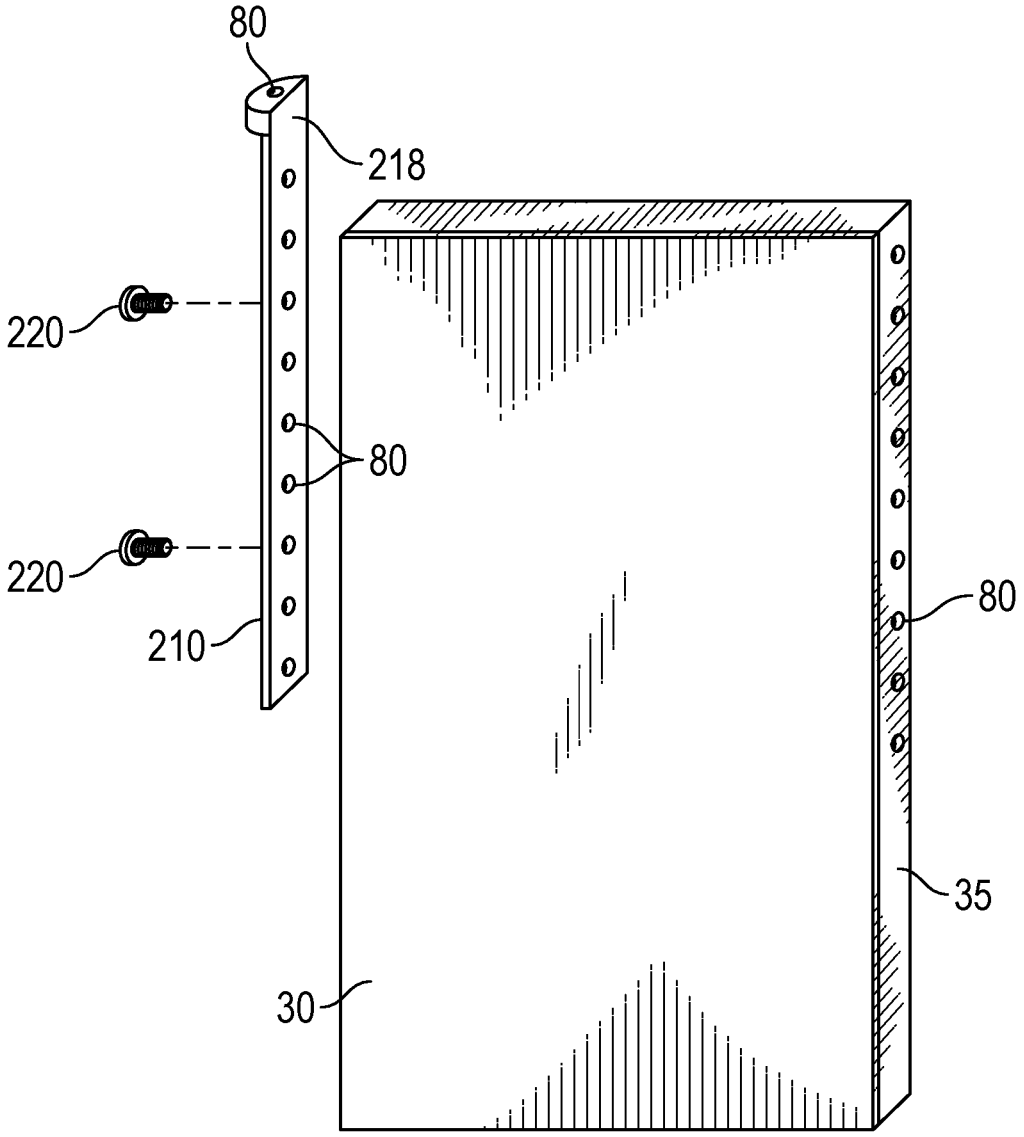
FIG. 10 is a partial exploded perspective view of an embodiment including an extension bracket.

The extension tube 160 may further include a pivot section 200 adapted to connect to an additional extension tube 161 at a selected and lockable angle with respect to the extension tube 160 (FIGS. 8A-8B). In some embodiments, additional extension tube 161 is telescoping. In some embodiments, the attachment member 180 is attached to extension tube 161. In some embodiments the lockable angle is between −90-degrees and 90-degrees. In some embodiments at least one additional extension tube (not shown) is configured to extend beyond the case 30 perpendicularly to the first extension tube 160, setting up a wide variety of other potential exercises that can be performed with the exercise system 10. In some embodiments, an attachable handle, similar to designed to extension tubes 164, 166, and 165

At least one extension brackets 210 (FIG. 10) may be included that is selectively attached with at least one mechanical fastener 220 to the at least one peripheral edge 35 of the case 30, a distal end 218 of which includes one of the anchor devices 80. As such, the at least one resistance band 40 may be attached to the distal end 218 of the extension bracket 210 to facilitate additional exercises that can be performed with the exercise system 10.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise system for a person in an environment, comprising:

a case having a base with a selectively openable top and at least one peripheral edge, the top when engaged with the base defining an internal storage volume therein, the top having a top surface for contacting the person, and the base having a bottom surface, wherein the bottom surface of the base includes a low-friction material adapted for facilitating the sliding of the case for contacting an item in the environment, wherein an anchoring device is integrated into the at least one peripheral edge, the top surface, or the bottom surface;

at least one resistance band, at least one anchor fixed with the at least one peripheral edge of the case and adapted for fixing with the at least one resistance band through one of the plurality of apertures thereof;

whereby with the at least one resistance band fixed with the case, and with the case pressed against the environment by the person, the person may perform exercises by stretching the at least one resistance band.

2. The exercise system of claim 1 wherein each anchor is selectively detachable from an anchor aperture traversing the case.

3. The exercise system of claim 1 wherein the low-friction material is included on a shell that is selectively attachable to the bottom surface of the base.

4. The exercise system of claim 1 wherein the bottom surface of the base includes a high-friction material for inhibiting sliding of the case.

5. The exercise system of claim 1 wherein the base further includes a plurality of partitions for dividing the internal storage volume into a plurality of compartments and for reinforcing the case.

6. The exercise system of claim 1 wherein the at least one peripheral wall includes at least one extension aperture through which an extension tube may be extended from within the case, the extension tube adapted for securing to at least one accessory item.

7. The exercise system of claim 6 wherein the at least one accessory item is one of the at least one anchors.

8. The exercise system of claim 6 wherein the at least one accessory item is a cross beam riser.

9. The exercise system of claim 8 wherein the cross-beam riser is adapted to hold a cross beam proximate the center thereof, the cross beam having two opposing ends each adapted to receive a grip thereon.

10. The exercise system of claim 9 wherein a distal end of each grip includes one of the anchor apertures.

11. The exercise system of claim 6 wherein the extension tube is a telescoping extension tube that includes at least one inner extension tube and at least one outer extension tube selectively mutually secured at a length adjustment mechanism.

12. The exercise system of claim 11 wherein the length adjustment mechanism comprises a plurality of alignable adjustment apertures in the inner extension tube and the outer extension tube, and at least one adjustment pin for selectively placing into two corresponding aligned adjustment apertures in both the inner and outer extensions rods to lock the inner and outer extension tubes mutually together.

13. The exercise system of claim 6 wherein the extension tube further includes a plurality of anchor apertures each adapted for selectively fixing one of the at least one anchors thereto.

14. The exercise system of claim 6 wherein the at least one accessory includes a grip, each grip having at a distal end thereof one of the anchoring device.

15. The exercise system of claim 6 wherein the extension tube further includes a pivot section adapted to connect to an additional extension tube at a selected and lockable angle with respect to the extension tube.

16. The exercise system of claim 1 wherein the at least one resistance band includes a raised, reinforced section around the aperture thereof, and wherein the at least one anchor includes a recessed portion cooperative with the raised, reinforced section of the resistance band to rotationally capture the resistance band on the anchor when the anchor is fixed with the resistance band and fully engaged with one of the anchor devices, whereby a pulling force experienced by the resistance band is transferred to the anchor as well as the recessed portion, reducing the force experienced by the anchor device anchor against the anchor.

17. The exercise system of claim 1 further including at least one extension bracket configured for selective attachment with at least one mechanical fastener to the at least one peripheral edge of the case, and a distal end of the at least one extension bracket including one of the anchor device.

18. An exercise system for a person in an environment, comprising:

a case having a base with a selectively openable top and at least one peripheral edge, the top when engaged with the base defining an internal storage volume therein, the top having a top surface for contacting the person, and the base having a bottom surface wherein the bottom surface of the base includes a low-friction material adapted for facilitating the sliding of the case for contacting an item in the environment and wherein the low friction material is included on a shell that is selectively attachable to the bottom surface of the base and wherein an anchoring device is integrated into the at least one peripheral edge, the top surface, or the bottom surface;

at least one resistance band, at least one anchor fixed with the at least one peripheral edge of the case and adapted for fixing with the at least one resistance band through one of the plurality of apertures thereof;

whereby with the at least one resistance band fixed with the case, and with the case pressed against the environment by the person, the person may perform exercises by stretching the at least one resistance band.

* * * * *